US006942508B2

(12) United States Patent
Wong

(10) Patent No.: US 6,942,508 B2
(45) Date of Patent: Sep. 13, 2005

(54) ELECTRICAL ADAPTER

(75) Inventor: Michael Pong Kei Wong, Hong Kong (CN)

(73) Assignee: Modern Sense Ltd., Shaukiwan (CN)

( * ) Notice: Subject to any disclaimer, the term of this patent is extended or adjusted under 35 U.S.C. 154(b) by 0 days.

(21) Appl. No.: 10/749,964

(22) Filed: Dec. 31, 2003

(65) Prior Publication Data

US 2005/0074996 A1 Apr. 7, 2005

(30) Foreign Application Priority Data

Jan. 3, 2003 (GB) ..... 0300098

(51) Int. Cl.[7] ..... H01R 29/00

(52) U.S. Cl. ..... 439/171; 439/176

(58) Field of Search ..... 439/171–176

(56) References Cited

U.S. PATENT DOCUMENTS 5,702,259 A * 12/1997 Lee ..... 439/137
6,062,884 A * 5/2000 Messimer et al. ..... 439/172
6,328,581 B1 * 12/2001 Lee et al. ..... 439/106
6,592,386 B2 * 7/2003 Teng et al. ..... 439/172
6,669,495 B2 * 12/2003 Philips et al. ..... 439/170

* cited by examiner

*Primary Examiner*—Michael C. Zarroli
(74) *Attorney, Agent, or Firm*—Alix, Yale & Ristas, LLP

(57) ABSTRACT

An electrical adapter includes a base having conducting pins extending from one side for insertion into apertures of a mating socket, electrical terminals on the other side and electrically connected to each of the conducting pins. The base a bayonet fitting. A body for connection to the base has a corresponding bayonet fitting for co-operating with the bayonet fitting of the base to secure the body to the base in a desired orientation. There are electrical contacts configured on the body to engage with the terminals of the base when the body and base are secured to one another. A power cord extends from the body.

16 Claims, 5 Drawing Sheets

ELECTRICAL ADAPTER

BACKGROUND OF THE INVENTION

The present invention relates to main power electrical connectors. More particularly, although not exclusively, the invention relates to a main power electrical adapter having a choice of configurations.

Electric plugs for insertion to wall sockets are of course known. These either comprise two or three pins, depending upon whether an earth pin is needed. The plugs have a power cord extending therefrom, usually directly outwardly from the wall, or otherwise in a direction parallel to the wall in a downward or downward and angularly-offset manner. Sometimes this pre-set angle at which the power cord extends from the plug body is inconvenient. For example, when the cord extends normally to the wall and it is desired to place furniture against the wall at that position, the furniture must often need to be spaced from the wall. If the power cord is short and extends downwardly from the plug when the plug is inserted into the wall socket, this can create problems where say it extends from a desk lamp for example to be positioned at a higher level than that of the wall socket. In such a situation, it would be more appropriate that the plug have the power cord extending upwardly instead of downwardly therefrom.

Also, the pin configuration of wall sockets and electrical plugs vary from country to country. When travelling with a laptop computer for example one often has to carry traveller's adapters. These can be bulky, cumbersome items.

OBJECTS OF THE INVENTION

It is an object of the present invention to overcome or substantially ameliorate at least one of the above disadvantages and/or more generally to provide an improved electrical adapter.

DISCLOSURE OF THE INVENTION

In one form, the invention comprises an electrical adapter for use in countries having mains electrical pin/socket patterns that allow no alternative plug-insertion orientations, comprising:

a base having electrical terminals and engagable pivot connection features, and a body having engager pivot connecting features for co-operating with the engagable pivot connection features of the base to secure the body rotatably to the base in one of only two possible orientations—one of which 180 offset with respect to the other, the body having electrical contacts configured to engage with the terminals of the base when the body and base are so secured.

In another form, the invention comprises an electrical adapter comprising:

a base having electrical terminals and engagable bayonet connection features, and a body having engager bayonet connecting features for co-operating with the engagable bayonet connection features of the base to secure the body rotatably to the base, the body having electrical contacts configured to engage with the terminals of the base when the body and base are so secured.

In a further form, the invention comprises an electrical adapter comprising:

a base having electrical terminals and engagable pivot connection features, a body having engager pivot connecting features for co-operating with the engagable pivot connection features of the base to secure the body rotatably to the base, the body having electrical contacts configured to engage with the terminals of the base when the body and base are so secured, and a locking device by which the body is automatically locked to the base when pivotally interconnected therewith, but that requires manual depression to unlock the body from the base.

Preferably the base has conducting pins extending from one side thereof for insertion into apertures of a mating socket and the electrical terminals are located on the other side of the base and correspond to each of the conducting pins and are connected electrically thereto.

Alternatively the base can have extending therefrom another power cord at a remote end of which there is a plug having conducting pins for insertion into apertures of a mating socket and wherein the electrical terminals are connected electrically to each of the conducting pins via individual conductors in said another power cord.

Preferably the engagable and engager pivot mounting features are mutually bayonet-inter-engagable.

Preferably the engagable pivot mounting features of the base comprise a number of radially extending lugs having circumferentially extending ramp surfaces.

Preferably the engager pivot mounting features of the body comprise openings through which the lugs must pass for interengagement of the base and the body to take place.

Preferably said lugs are of differing size and said openings are of corresponding differing size to restrict allowable alignment orientations of the body and base when interconnected.

Preferably the base comprises an annular channel within which the terminals are located.

Preferably the terminals are located within narrowed parts of the channel.

Preferably the body includes a locking device by which the base is locked to the body when interconnected therewith.

Preferably the electrical contacts of the body are spring-biased toward the terminals.

Preferably the electrical contacts of the body are connected to individual conductors of a power cord extending from the body.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

In the accompanying drawings there is schematically depicted an adapter base 10 and a mating plug body 20.

Figure 1:
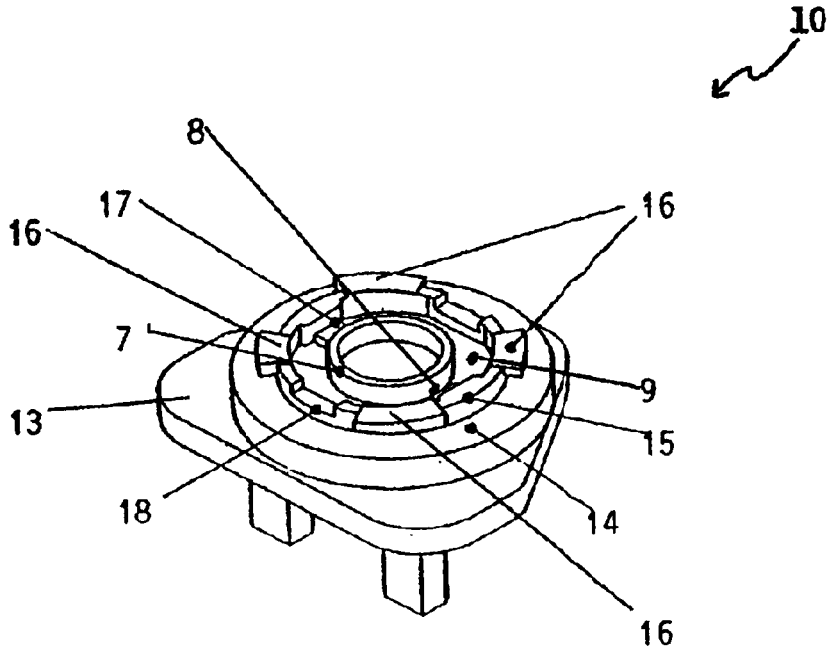
FIG. 1 is a schematic perspective illustration of the base.
Figure 2:
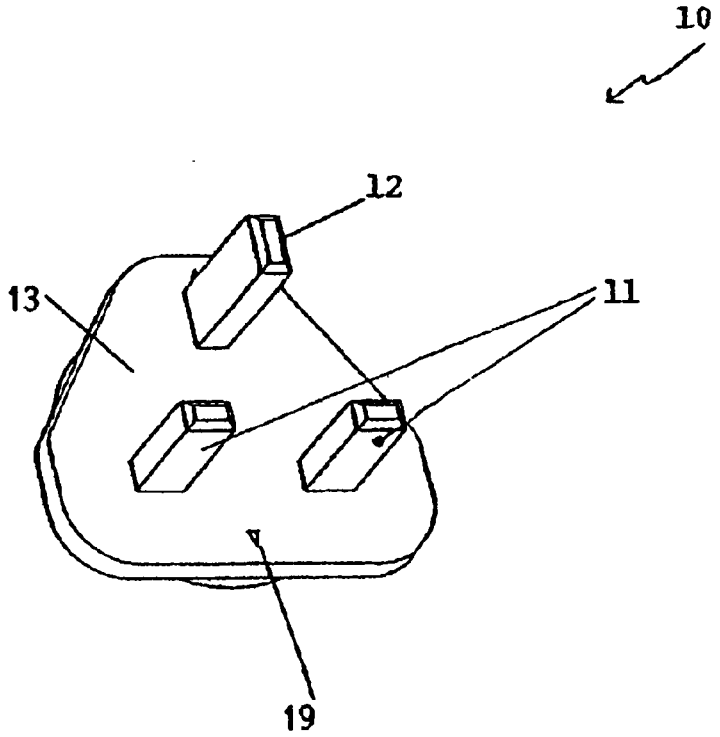
FIG. 2 is a schematic inverted perspective illustration of the base.

FIGS. 1 and 2 depict the adapter base 10. The adapter base 10 is fabricated typically as a moulding of plastics material and includes a plate 13 having three projecting metallic electrically conductive pins projecting from one side. There are active and neutral pins 11 and an earth pin 12. Alternatively, there might simply be a pair of active and neutral pins. As yet a further alternative, the pin 12 might be a plastics or other non-conductive dummy pin. The adapter base 10 of the illustrated embodiment has its pins configured in the standard British layout, but it should be appreciated that the pin configuration could equally be that of Australia, the USA, or any other country. Indeed, the plug body 20 of FIGS. 3 and 4 might be supplied with a number of bases 10, each base having a configuration applicable for a different country.

At the other side of the plate 13 there is provided a flat bearing ring 14 formed as an integral moulding therewith. Located internally and concentrically with the bearing surface 14 is an inner circular projecting rail 7 and an outer circular rail 15. Between the two rails there is defined and annular channel 9 having a pair of diametrically opposed narrowed portions 8. At the bottom part of each narrowed portion 8 there is provided a terminal 17. One of the terminals is connected electrically with either the active or neutral pin 11 and the other terminal is connected to the other pin 11. There might also be a further terminal 17 connected with the earth pin 12.

The outer rail 15 has extending therefrom four bayonet lugs 16. Each bayonet lug 16 is spaced from the bearing surface 14 and includes a circumferentially extending ramped upper surface. Diametrically opposed pairs of the bayonet lugs 16 are of the same size, yet adjacent pairs of the bayonet lugs are of differing size.

Figure 3:
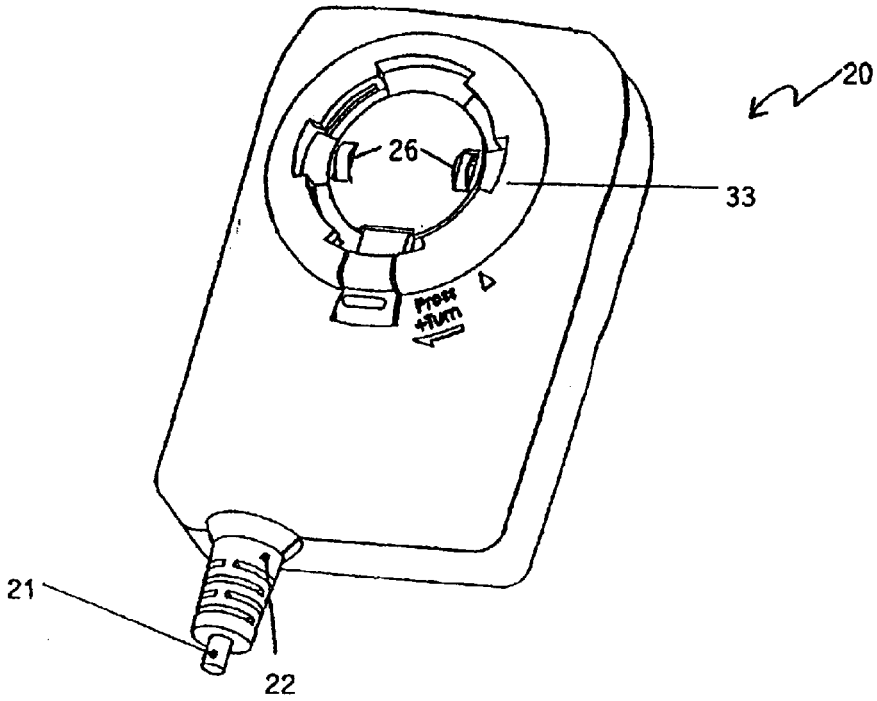
FIG. 3 is a schematic perspective illustration of a body for connection to the base of FIGS. 1 and 2.
Figure 4:
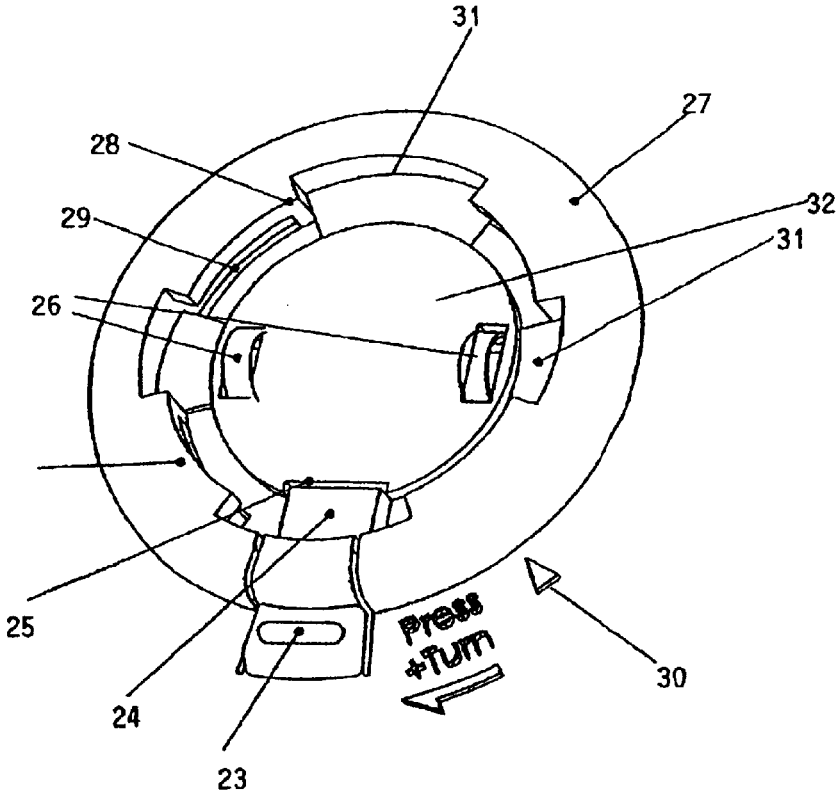
FIG. 4 is a schematic perspective detailed illustration of parts of the body of FIG. 3, FIGS. 5 and 6 are schematic perspective illustrations of the body and base showing the base in its alternative insertion orientations.

FIGS. 3 and 4 depict a plug body 20 for bayonet-interconnection with the adapter base 10. The plug body 20 is typically fabricated from several plastics moulded parts that are screwed, snapped or welded together ultrasonically and has extending from it via a rubber grommet 22 a power cord 21.

Figure 5:
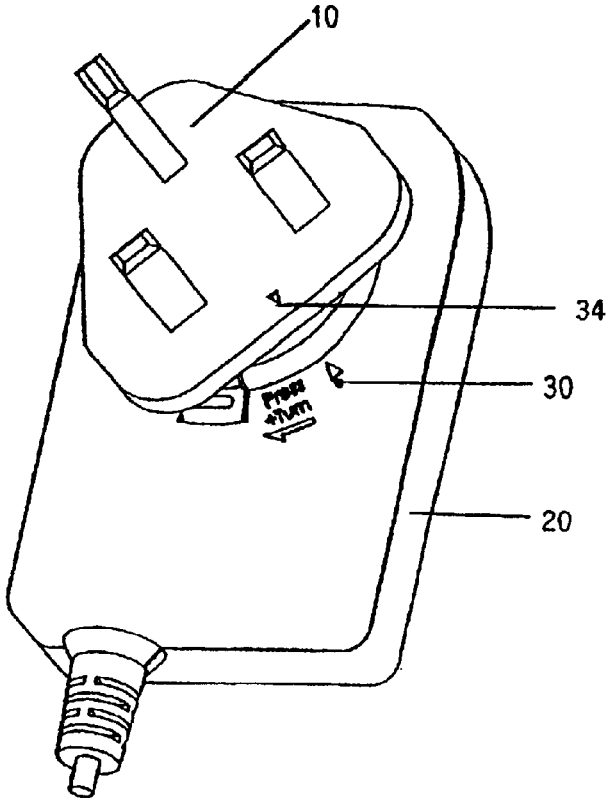
Figure 6:
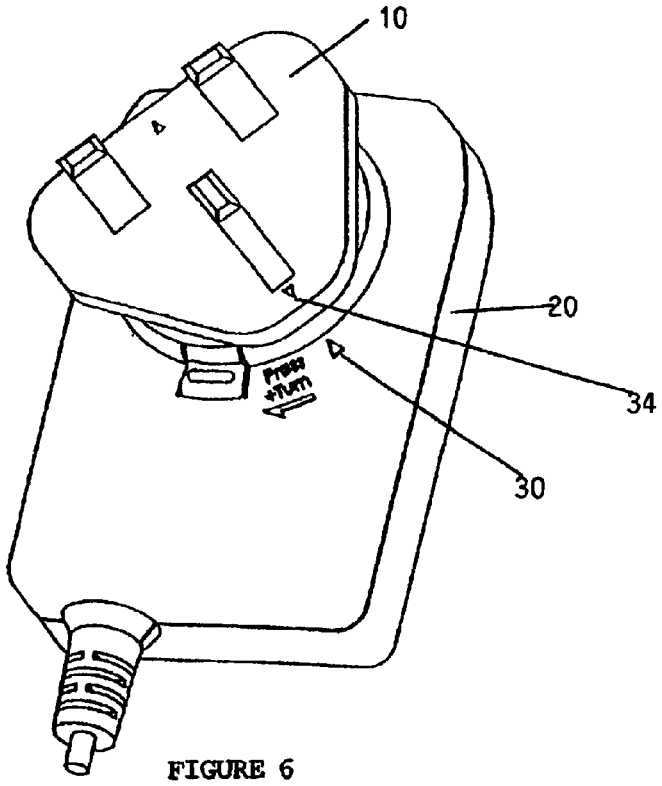

The plug body 20 includes a flat circular bearing ring 33 for engagement with the bearing ring 14 of the adapter base 10. There is a central recess 32 in which there is located a pair of diametrically opposed electrical spring contacts 26. These spring contacts are connected electrically with individual conductors within the cord 21. Located around the central recess 32 there are four openings 31. Diametrically opposed pairs of the openings 31 are of the same size, whereas adjacent pairs are of different size. By this arrangement, bayonet lugs of the adapter base 10 can be lowered into the openings 31 of the plug body 20 in only two possible orientations, namely those as depicted in FIGS. 5 and 6 respectively.

That is, the openings 31 are just large enough to receive the lugs and the larger pair of the four lugs will not fit into the smaller openings.

Alongside each opening 31 and situated beneath the bearing ring 33 are lug-receiving slots 29. There are ramp surfaces at the bottom of each opening 31.

Situated alongside and projecting within one of the openings 31 is a locking device comprising an interlock tongue 24 and an activator 23 formed integrally therewith. The tongue 24 projects into a tongue recess 25 as depicted in FIG. 4. With reference again to FIG. 1, the outer rail 15 includes a pair of diametrically opposed interlock recesses 18 into one of which the tongue 24 snap-engages upon bayonet-fitting of the two components. The activator 23 is an integral part of the plug body 20 and has a pair of cut-outs at either side enabling downward movement of the interlocked tongue 24 upon application of finger-pressure to the activator 23. It is only upon this application of finger pressure that the interlocked parts can be detached.

Figure 7:
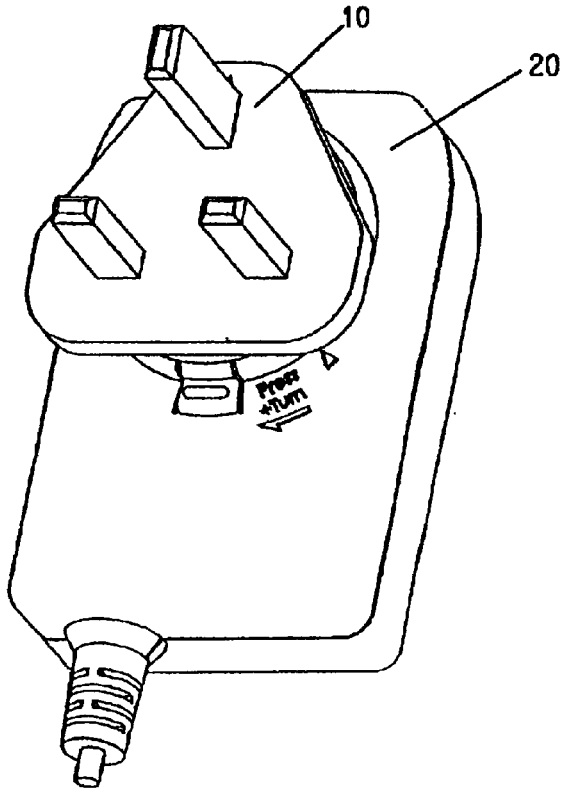
FIGS. 7 and 8 are schematic perspective illustrations of the body and base with the base illustrated in alternate locked orientations.
Figure 8:
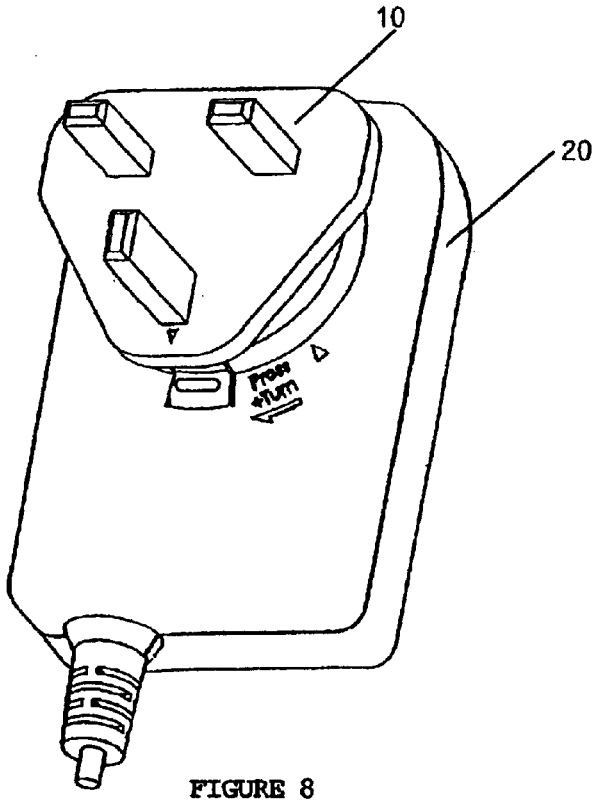

In use, parts 10 and 20 are attached as shown in FIG. 5 and 6 and then the adapter based 10 is rotated clockwise until the bayonet lugs bear against end walls 28 at each slot 29. At this time, the interlock tongue 24 snaps into one of the interlock recesses 18, depending upon the chosen orientation as depicted in either of FIG. 7 or 8. The attached components can then be plugged into a wall socket, plug board, or extension cord for example.

There is an alignment indicator 30 on the plug body 20 and a corresponding pair of indicators 34 on the adapter base to assist in aligning the components as illustrated in FIGS. 5 and 6.

It should be appreciated that modifications and alterations obvious to those skilled in the art are not to be considered as beyond the scope of the present invention. For example, there might be located within the plug body 20 a transformer to provide a low voltage output to the power cord 21. Also, instead of a bayonet-type interengagement, other types of plug-in arrangements might be adopted.

Figure 9:
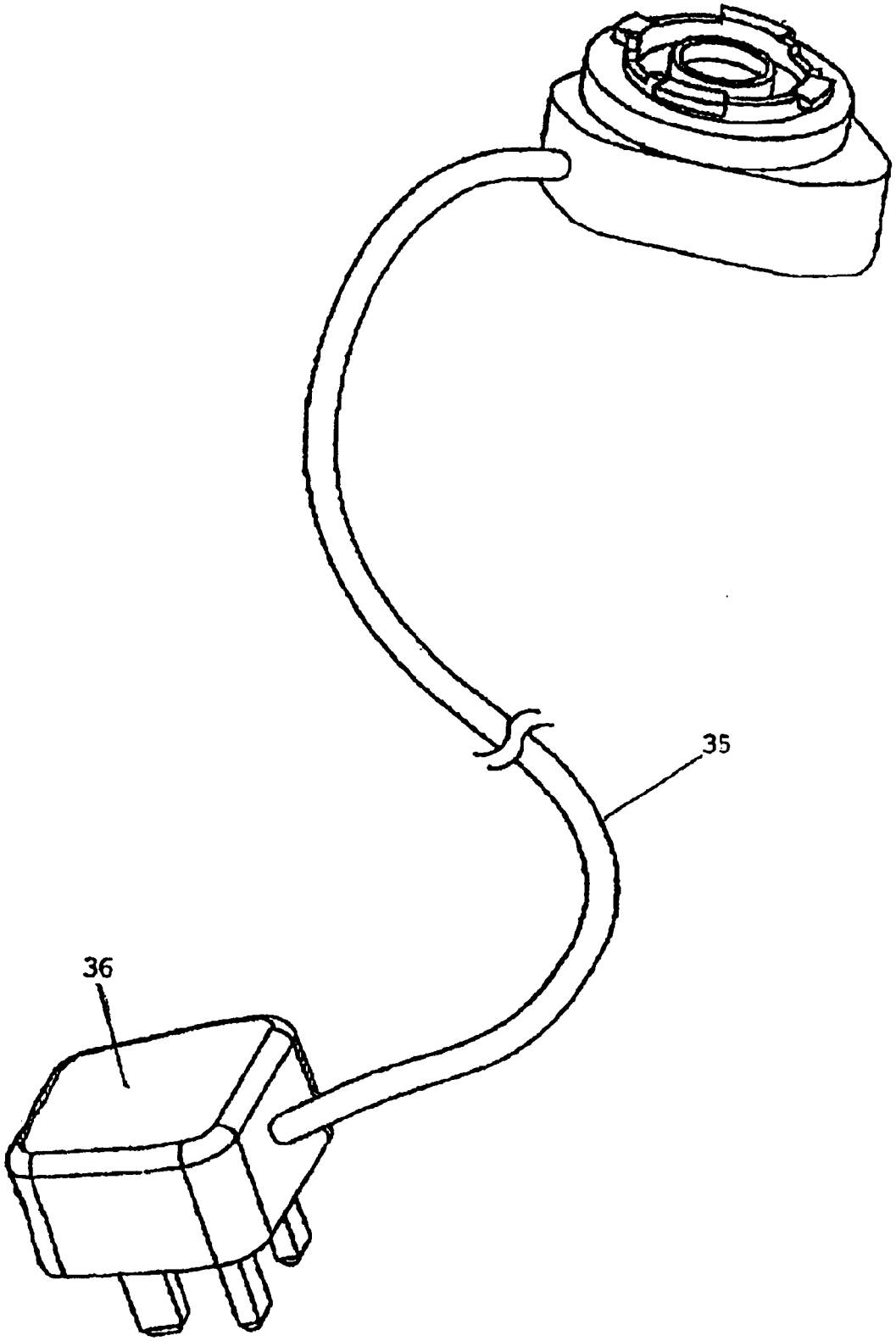
FIG. 9 is a schematic perspective illustration of an alternative base having an extension cord extending therefrom with a plug at its remote end.

Furthermore, it is envisaged that the base of the electrical adapter need not the configured with pins to be received directly by apertures of a mating socket. For example, and as shown in FIG. 9, the base might have an extension cord 35 extending therefrom and at the remote end of which there is a standard plug 36 to be received by a wall socket or another extension cord for example.

Also, the body might be formed integrally with an electrical appliance, double adapter, multiple plug board, transformer box or the like.

What is claimed is:

1. An electrical adapter for use in countries having main electrical pin/socket patterns that allow no alternative plug-insertion orientations, comprising:

a base having conducting pins extending from one side thereof for insertion into apertures of a mating socket and electrical terminals located on the other side of the base and which correspond to each of the conducting pins and are connected electrically thereto, and engagable pivot connection features, and a body having engager pivot connecting features co-operating with the engagable pivot connection features of the base to secure the body rotatably to the base in one of only two possible orientations—one of which is 180° offset with respect to the other, the body having electrical contacts configured to engage with the terminals of the base when the body and base are so secured.

2. The electrical connector of claim 1 wherein the body is integrated into an electrical appliance, double adapter, multiple plug board, transformer box or the like.

3. The electrical adapter of claim 1 wherein the base has extending therefrom a power cord at a remote end of which there is a plug having conducting pins for insertion into apertures of a mating socket and wherein the electrical terminals are connected electrically to each of the conducting pins via individual conductors in the power card.

4. An electrical adapter for use in countries having main electrical pin/socket patterns that allow no alternative plug-insertion orientations, comprising:

a base having electrical terminals and engagable pivot connection features, wherein the base has extending therefrom a power cord at a remote end of which there is a plug having conducting pins for insertion into apertures of a mating socket and wherein the electrical terminals are connected electrically to each of the conducting pins via individual conductors in the power card, and a body having engager pivot connecting features co-operating with the engagable pivot connection features of the base to secure the body rotatably to the base in one of only two possible orientations—one of which is 180° offset with respect to the other, the body having electrical contacts configured to engage with the terminals of the base when the body and base are so secured.

5. The electrical adapter of claim 4 wherein the base has conducting pins extending from one side thereof for insertion into apertures of a mating socket and the electrical terminals are located on the other side of the base and correspond to each of the conducting pins and are connected electrically thereto.

6. An electrical adapter for use in countries having main electrical pin/socket patterns that allow no alternative plug-insertion orientations, comprising:

a base having electrical terminals and engagable pivot connection features wherein the engagable pivot connection features of the base comprise a number of radially extending lugs having circumferentially extending ramps surfaces, and a body having engager pivot connecting features co-operating with the engagable pivot connection features of the base to secure the body rotatably to the base in one of only two possible orientations—one of which is 180° offset with respect to the other, the body having electrical contacts configured to engage with the terminals of the base when the body and base are so secured.

7. The electrical connector of claim 6 wherein the engager pivot connection features of the body comprise openings through which the lugs must pass for interengagement of the base and the body to take place.

8. The electrical connector of claim 6 wherein said lugs are of differing size and said openings are of corresponding differing size to restrict allowable alignment orientations of the body and base when interconnected.

9. An electrical adapter for use in countries having main electrical pin/socket patterns that allow no alternative plug-insertion orientations, comprising:

a base comprising an annular channel having narrowed parts within which electrical terminals are located and engagable pivot connection features, and a body having engager pivot connecting features co-operating with the engagable pivot connection features of the base to secure the body rotatably to the base in one of only two possible orientations—one of which is 180° offset with respect to the other, the body having electrical contacts configured to engage with the terminals of the base when the body and base are so secured.

10. The electrical adapter of claim 9 wherein the base has extending therefrom a power cord at a remote end of which there is a plug having conducting pins for insertion into apertures of a mating socket and wherein the electrical terminals are connected electrically to each of the conducting pins via individual conductors in the power card.

11. An electrical adapter for use in countries having main electrical pin/socket patterns that allow no alternative plug-insertion orientations, comprising:

a base having electrical terminals and engagable pivot connection features, and a body having engager pivot connecting features co-operating with the engagable pivot connection features of the base to secure the body rotatably to the base in one of only two possible orientations—one of which is 180° offset with respect to the other, the body having electrical contacts, spring- biased toward the terminals, configured to engage with the terminals of the base when the body and base are so secured.

12. The electrical adapter of claim 11 wherein the base has conducting pins extending from one side thereof for insertion into apertures of a mating socket and the electrical terminals are located on the other side of the base and correspond to each of the conducting pins and are connected electrically thereto.

13. An electrical adapter for use in countries having main electrical pin/socket patterns that allow no alternative plug-insertion orientations, comprising:

a base having electrical terminals which are connected to individual conductors of a power cord extending from the body, and engagable pivot connection features, and a body having engager pivot connecting features co-operating with the engagable pivot connection features of the base to secure the body rotatably to the base in one of only two possible orientations—one of which is 180° offset with respect to the other, the body having electrical contacts configured to engage with the terminals of the base when the body and base are so secured.

14. An electrical adapter comprising:

a base having electrical terminals and engagable bayonet connection features, and a body having engager bayonet connecting features co-operating with the engagable bayonet connection features of the base to secure the body rotatably to the base, the body having electrical contacts configured to engage with the terminals of the base when the body and base are so secured, wherein the bayonet connecting features of the base comprise a number of radially extending lugs having circumferentially extending ramp surfaces.

15. An electrical adapter comprising:

a base having electrical terminals and engagable pivot connection features, a body having engager pivot connecting features co-operating with the engagable pivot connection features of the base to secure the body rotatably to the base, the body having electrical contacts configured to engage with the terminals of the base when the body and base are so secured, wherein the engagable pivot connecting features of the base comprise a number of radially extending lugs having circumferentially extending ramp surfaces, and a locking device by which the body is automatically locked to the base when pivotally interconnected therewith, but that reguires manual depression to unlock the body from the base.

16. An electrical adapter comprising:

a base having electrical terminals and engagable pivot connection features, wherein the base comprises an annular channel within which the terminals are located;

a body having engager pivot connecting features co-operating with the engagable pivot connection features of the base to secure the body rotatably to the base, the body having electrical contacts configured to engage with the terminals of the base when the body and base are so secured, and a locking device by which the body is automatically locked to the base when pivotally interconnected therewith, but that reguires manual depression to unlock the body from the base.

* * * * *

UNITED STATES PATENT AND TRADEMARK OFFICE

CERTIFICATE OF CORRECTION

PATENT NO. : 6,942,508 B2
APPLICATION NO. : 10/749964
DATED : September 13, 2005
INVENTOR(S) : Wong It is certified that error appears in the above-identified patent and that said Letters Patent is hereby corrected as shown below:

Column 4:
Line 67, after "power" delete "card" and substitute --cord--.

Column 5:
Lines 10-11, after "power" delete "card" and substitute --cord--.

Lines 30-31, delete "connection" and substitute --connecting--.

Line 43, delete "connection" and substitute --connecting--.

Column 6:
Line 3, after "power" delete "card" and substitute --cord--.

Column 8:
Line 3, delete "reguires" and substitute --requires--.

Signed and Sealed this

Nineteenth Day of September, 2006

JON W. DUDAS
*Director of the United States Patent and Trademark Office*